US006596954B2

(12) United States Patent
Miyashita

(10) Patent No.: US 6,596,954 B2
(45) Date of Patent: Jul. 22, 2003

(54) TACTILE SWITCH

(75) Inventor: Isao Miyashita, Yamanashi-ken (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 0 days.

(21) Appl. No.: 10/073,009

(22) Filed: Feb. 12, 2002

(65) Prior Publication Data

US 2002/0125120 A1 Sep. 12, 2002

(30) Foreign Application Priority Data

Mar. 6, 2001 (JP) ..... 2001-062715

(51) Int. Cl.[7] ..... H01H 5/30
(52) U.S. Cl. ..... 200/406; 200/516
(58) Field of Search ..... 200/406, 512, 200/516, 515

(56) References Cited

U.S. PATENT DOCUMENTS 4,046,981 A * 9/1977 Johnson et al. ..... 200/516
4,263,485 A * 4/1981 Corwin ..... 200/5 A
4,412,113 A 10/1983 Mitsugi et al. ..... 200/670
4,794,215 A * 12/1988 Sawada et al. ..... 200/512
5,144,104 A * 9/1992 Bedoya ..... 200/512

FOREIGN PATENT DOCUMENTS

JP 6310569 11/1984 ..... H01L/21/60
JP 01260843 10/1989 ..... H01L/23/00
JP 11026895 1/1999 ..... H05K/1/02

* cited by examiner

*Primary Examiner*—Michael Friedhofer
(74) *Attorney, Agent, or Firm*—Dennison, Schultz & Dougherty

(57) ABSTRACT

A peripheral fixed contact having a circular hole is secured to a substrate, and a central fixed contact having a hole at a central portion thereof is secured to the substrate within the circular hole of the peripheral fixed contact. A spherical spring contact is mounted on the peripheral fixed contact so as to contact with an edge of the hole of the central fixed contact.

4 Claims, 5 Drawing Sheets

TACTILE SWITCH

BACKGROUND OF THE INVENTION

The present invention relates to a tactile switch used in a portable telephone, portable radio receiver, camera and others.

FIG. 6 is a plan view showing a conventional tactile switch, FIG. 7 is a sectional view taken along a line VII—VII of FIG. 6, FIG. 8 is a plan view showing another conventional tactile switch and FIG. 9 is a sectional view taken along a line IX—IX of FIG. 8.

The tactile switch has a side of 4 mm and a thickness of 0.5 mm. The switch has a substrate 1, a peripheral fixed contact 5 printed on the substrate 1 and having a circular hole 5*a* at a central portion thereof, a central fixed contact 6, printed on the substrate 1 in the circular hole 5*a*, a spherical spring contact 4 mounted on the peripheral fixed contact 5 and a flexible cover 21 made of plastic and adhered to the peripheral fixed contact 5 so as to press the spring contact 4 against the peripheral fixed contact.

Each of four corners of the substrate has a semicircular recess. Four terminal electrodes 9*a* to 9*d* are secured to the semicircular recesses and to the underside of the substrate 1 in order to connect the tactile switch with an instrument to be mounted therein.

The peripheral fixed contact 5 is connected to the terminal electrode 9*a*.

The central fixed contact 6 is connected to the terminal electrode 9*c* by a lead provided in a through-hole 7 and a conductive pattern 8.

The spring contact 4 is depressed through the cover 21 by a push button provided in the instrument, so that a central portion of the spring contact 4 is downwardly bent. The spring contact contacts with the central fixed contact 6, so that the peripheral fixed contact 5 is connected to the central fixed contact 6.

The switch shown in FIGS. 8 and 9 comprises a plurality of fixed contacts 5, 6 shown in FIGS. 6 and 7, provided on a substrate 22, a plurality of spring plates 4 and a cover 23 adhered to the substrate 22.

In the conventional switch, the cover 21 (23) contacts with the spring contact 4 at the entire surface of the spring contact 4.

Therefore, the contact area of the spring plate 4 with the central fixed contact is comparatively large. As a result, the contact pressure of the spring plate on the central fixed contact is low, which causes the reliability of the switch to decrease.

SUMMARY OF THE INVENTION

An object of the present invention is to provide a tactile switch in which the spring contact contacts with the central fixed contact at a high pressure, thereby increasing the reliability of the switch.

According to the present invention, there is provided a tactile switch comprising a substrate, a peripheral fixed contact having a circular hole and secured to the substrate, a central fixed contact having a hole at a central portion thereof and secured to the substrate within the circular hole of the peripheral fixed contact, a spherical spring contact mounted on the peripheral fixed contact so as to contact with an edge of the hole of the central fixed contact.

The hole of the central fixed contact has inward projection.

The tactile switch further comprises an annular spacer made of insulation material and secured to the substrate, and a flexible cover secured to the spacer, the spring contact being provided within the spacer.

The tactile switch further comprises marks provided on an upper surface and on underside of the switch for detecting the upper surface.

These and other objects and features of the present invention will become more apparent from the following detailed description with reference to the accompanying drawings.

DETAILED DESCRIPTION OF THE PREFERRED EMBODIMENT

Figure 1:
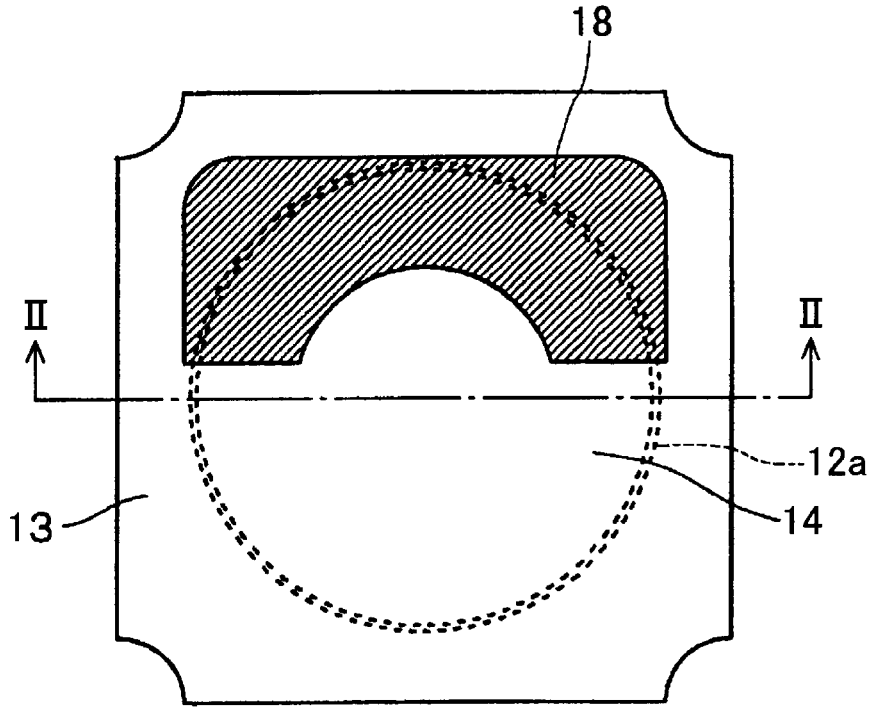
FIG. 1 is a plan view of a tactile switch of the present invention.
Figure 2:
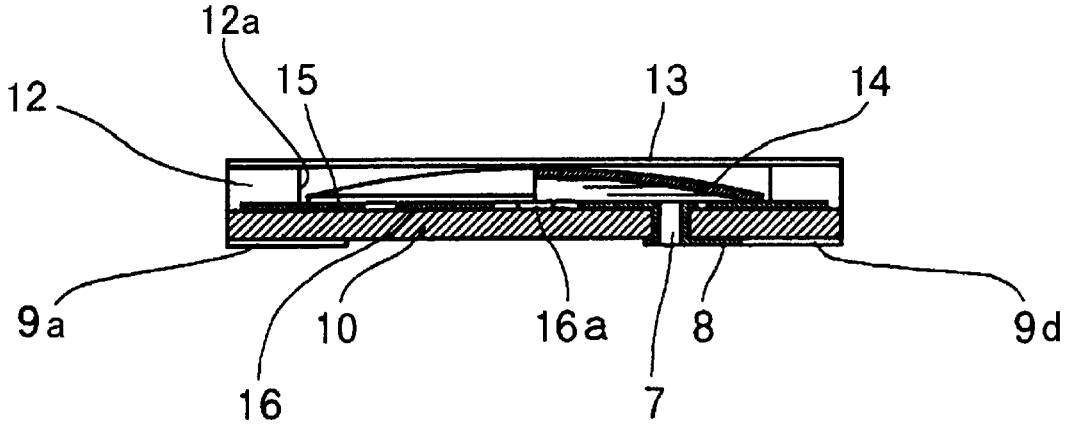
FIG. 2 is a sectional view taken along a line II—II of FIG. 1.
Figure 4:
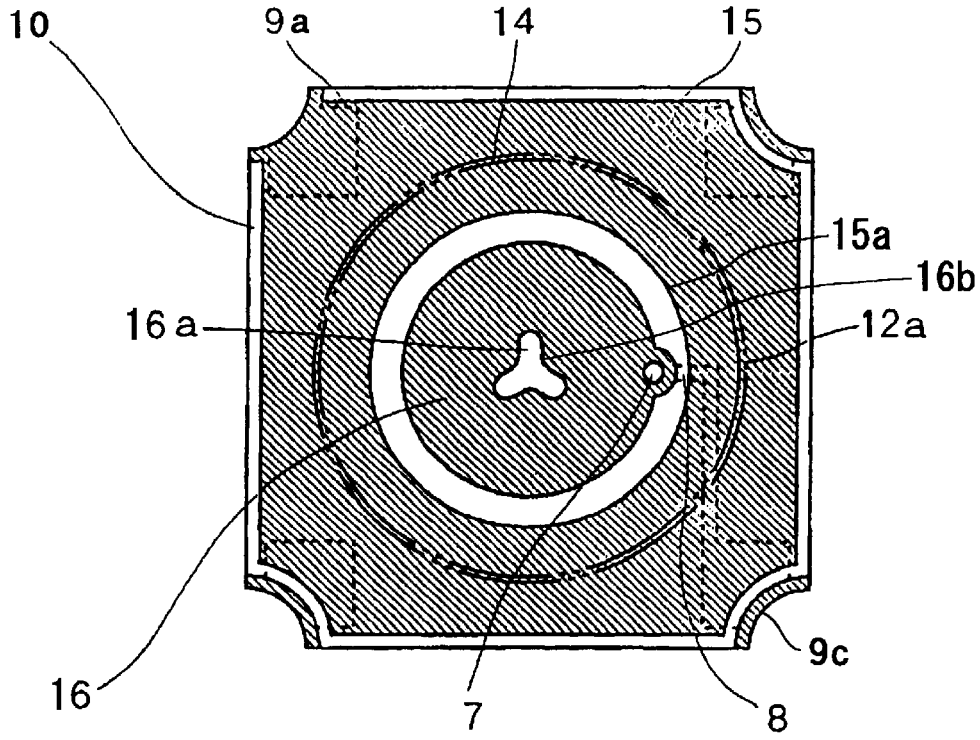
FIG. 4 is a plan view for showing a peripheral fixed contact and a central fixed contact.

Referring to FIGS. 1, 2 and 4, the tactile switch has a substrate 10, a peripheral fixed contact 15 having a circular hole 15*a* and secured to the substrate 10, a central contact 16 secured to the substrate 10 at a central portion of the substrate 10 within the hole of the peripheral fixed contact, a spring contact 14 mounted on the peripheral fixed contact 15.

An annular spacer 12 made of insulation material such as polyimide and having a circular hole 12*a* is adhered to the peripheral fixed contact and to the substrate 10. The spacer 12 has a thickness larger than the height of the spring contact 14 and the diameter of the hole 12*a* is larger than that of the spring contact. A flexible cover 13 made of plastic is adhered to the spacer 12 so as to provide a watertight sealing. Thus, the spring contact 14 is surrounded by the spacer 12 and the cover 13.

In accordance with the present invention, a hole 16*a* having inward projections 16*b* is formed in the central fixed contact 16. Although the hole 16*a* has an inverted Y-shape, another shape such as a star shape, cross shape, circular shape, and others can be used.

Figure 3:
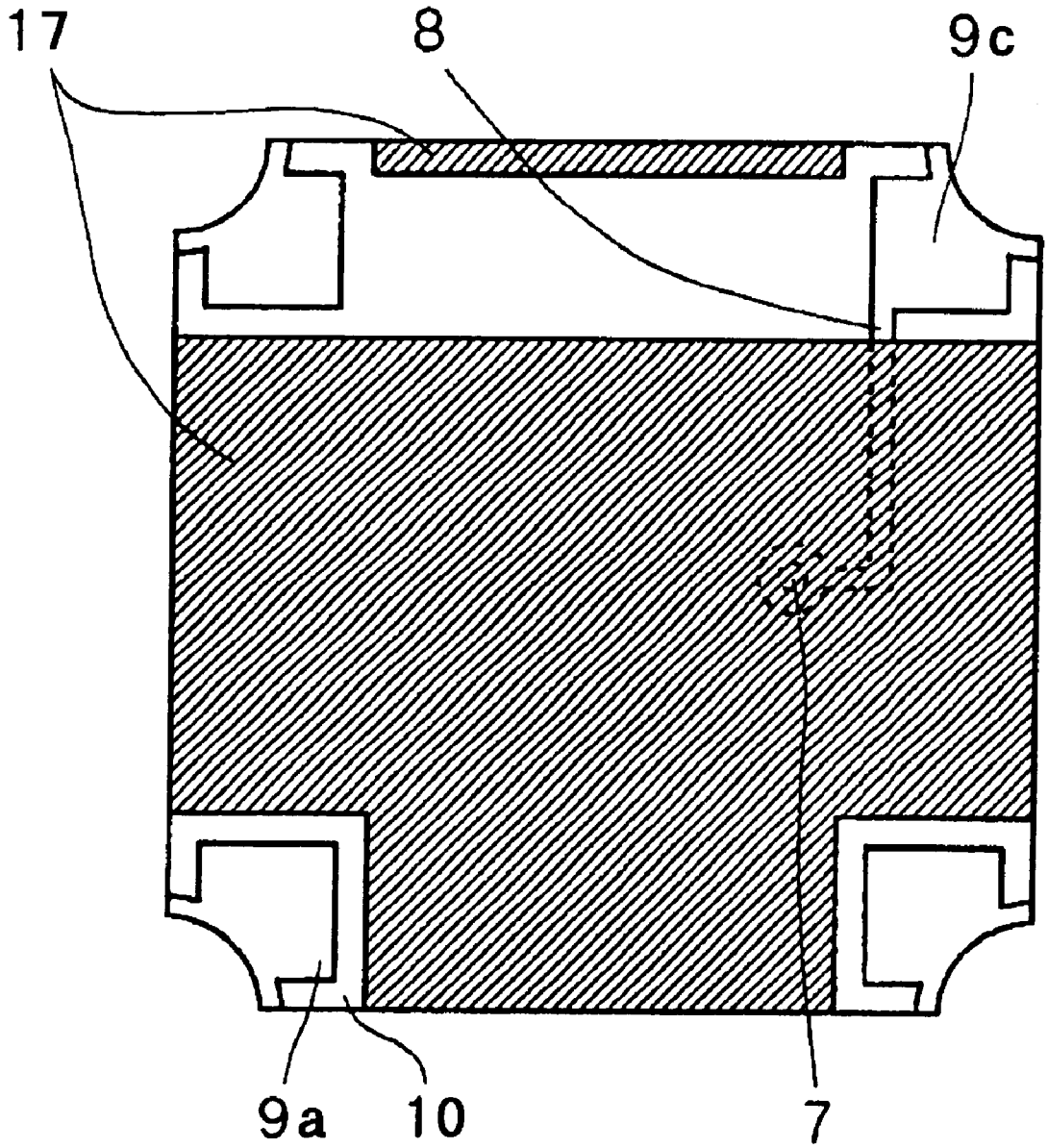
FIG. 3 is a bottom view of the tactile switch.

Referring to FIGS. 1 and 3, an identification mark 18 having a color of white or green or black is printed on the cover 13, and identification marks 17 of white are printed on the underside of the substrate 10. The marks 18 and 17 are provided for identifying the upper surface and the position of the switch.

Figure 6:
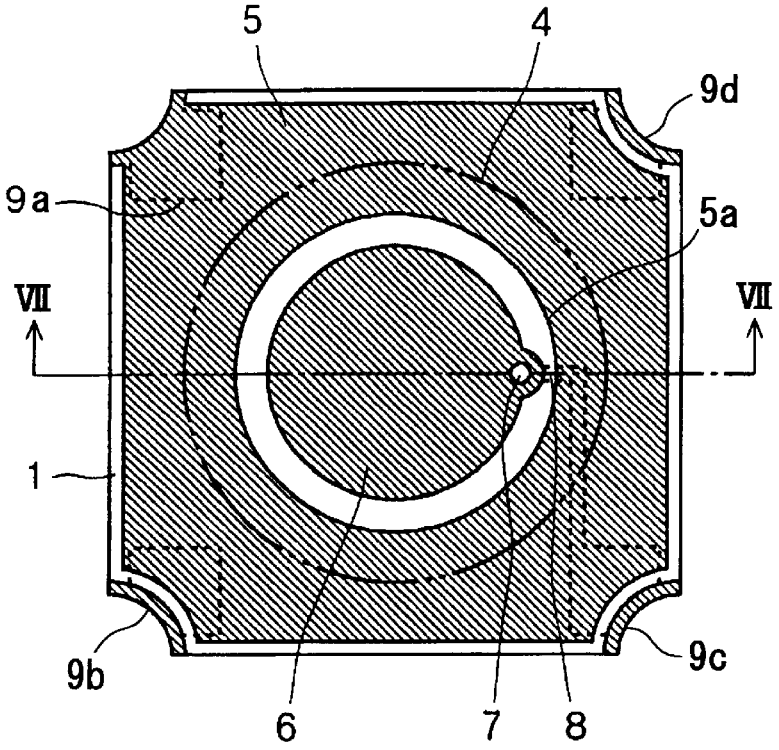
FIG. 6 PRIOR ART
FIG. 6 is a plan view showing a conventional tactile switch.
Figure 7:
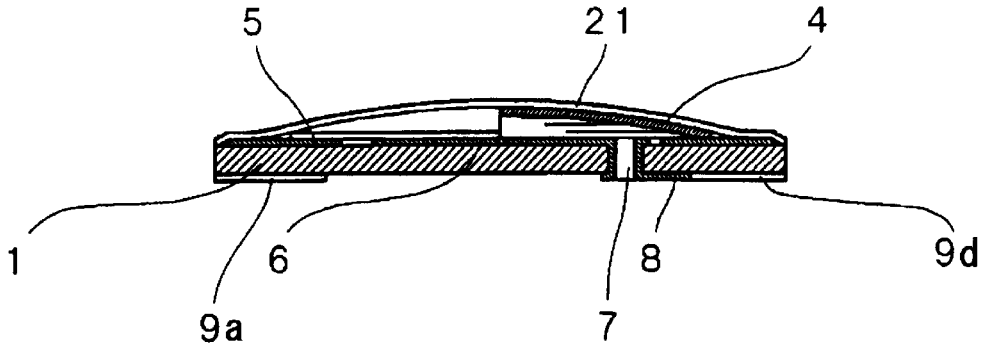
FIG. 7 PRIOR ART
FIG. 7 is a sectional view taken along a line VII—VII of FIG. 6.
Figure 8:
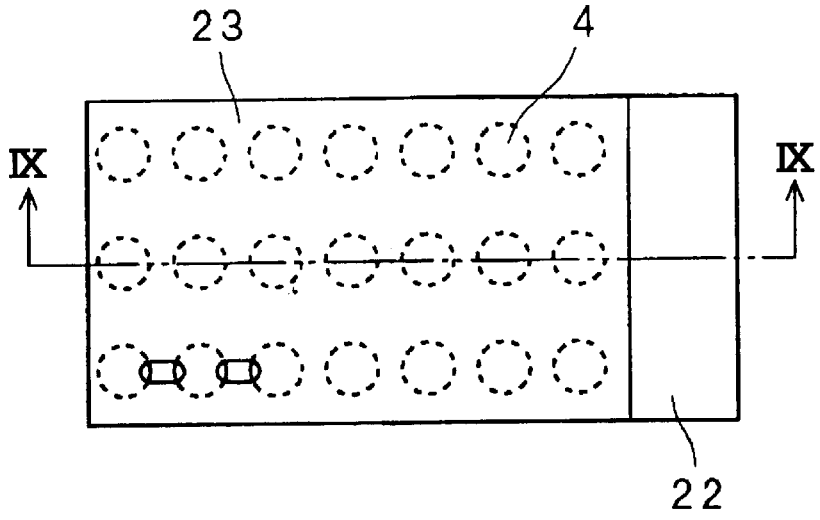
FIG. 8 PRIOR ART
FIG. 8 is a plan view showing another conventional tactile switch.
Figure 9:
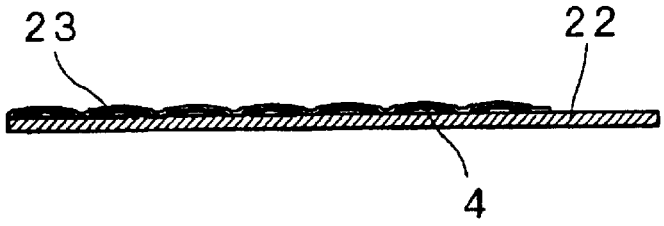
FIG. 9 PRIOR ART
FIG. 9 is a sectional view taken along a line IX—IX of FIG. 8.

Other parts are the same as the conventional switch in construction, and the same numeral references as FIGS. 6 and 7 are used for identifying, and the explanation thereof is omitted.

When the cover 13 is depressed, a central portion of the spring contact 14 is downwardly bent. When the central portion of the spring contact 14 passes a neutral point, the spring contact is quickly inverted. Thus, the spring contact 14 contacts with the central fixed contact 16 as shown in FIG. 5.

Figure 5:
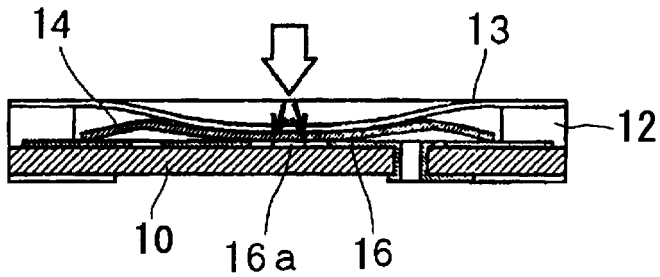
FIG. 5 is a sectional view showing the operation of the switch.

The spring contact 14 contacts with edges of projections 16*a* of the hole 16 as shown by arrows of FIG. 5. Therefore, contact area of the spring contact 14 to the central fixed contact 16 is very small. Consequently, the contact pressure is very high compared with that of the conventional switch shown in FIGS. 6 and 7, so that the contact of the switch is reliably ensured. Further, dirt and oxidation film on the contacts 14 and 16 are removed by the high contact pressure, thereby keeping the contact surface clean.

In addition, since the height of the spherical top of the spring contact 14 becomes high due to the spacer 12, the top portion is largely inverted, and a peripheral portion of the spring contact does not contact with the cover 13 as shown in FIG. 5 so that the contact pressure further becomes high. Thus high reliability of the switch can be further ensured.

Furthermore, the upper surface and the position of the switch can be detected by optically detecting the identifying marks 18 and 17, so that the switch can be automatically set in an instrument by a setting machine.

While the invention has been described in conjunction with preferred specific embodiment thereof, it will be understood that this description is intended to illustrate and not limit the scope of the invention, which is defined by the following claims.

What is claimed is:

1. A tactile switch comprising:

a substrate;

a peripheral fixed contact having a circular hole and secured to the substrate;

a central fixed contact having a hole at a central portion thereof and secured to the substrate within the circular hole of the peripheral fixed contact;

a spherical spring contact mounted on the peripheral fixed contact so as to contact with an edge of the hole of the central fixed contact.

2. The tactile switch according to claim 1 wherein the hole of the central fixed contact has inward projection.

3. The tactile switch according to claim 1 further comprising an annular spacer made of insulation material and secured to the substrate, and a flexible cover secured to the spacer, the spring contact being provided within the spacer.

4. The tactile switch according to claim 1 further comprising marks provided on an upper surface and on underside of the switch for detecting the upper surface.

* * * * *